US006983567B2

(12) United States Patent
Ciotti

(10) Patent No.: US 6,983,567 B2
(45) Date of Patent: Jan. 10, 2006

(54) CONTAINERIZED HABITABLE STRUCTURES

(76) Inventor: Theodore T. Ciotti, 2828 Gulf Gate Dr., Sarasota, FL (US) 34231

( * ) Notice: Subject to any disclaimer, the term of this patent is extended or adjusted under 35 U.S.C. 154(b) by 0 days.

(21) Appl. No.: 10/284,748

(22) Filed: Oct. 31, 2002

(65) Prior Publication Data

US 2003/0051417 A1 Mar. 20, 2003

Related U.S. Application Data

(63) Continuation of application No. 09/965,741, filed on Sep. 28, 2001, now abandoned.

(60) Provisional application No. 60/236,188, filed on Sep. 29, 2000.

(51) Int. Cl.
*E04H 1/00* (2006.01)

(52) U.S. Cl. ..... 52/79.5; 52/71; 52/79.1; 52/79.9; 52/64

(58) Field of Classification Search ..... 52/64, 52/65, 66, 68, 69, 71, 79.1, 79.5, 79.9, 70, 52/72

See application file for complete search history.

(56) References Cited

U.S. PATENT DOCUMENTS

| | | | | | |
|---|---|---|---|---|---|
| 2,155,876 | A | * | 4/1939 | Stout | 52/69 |
| 3,866,365 | A | * | 2/1975 | Honigman | 52/70 |
| 4,072,120 | A | | 2/1978 | Bylo | 114/72 |
| 4,075,814 | A | | 2/1978 | Theurer et al. | 52/79.5 |
| 4,242,846 | A | * | 1/1981 | Hurd et al. | 52/71 |
| 4,534,141 | A | | 8/1985 | Fagnoni | 52/68 |
| 4,633,626 | A | * | 1/1987 | Freeman et al. | 52/71 |
| 4,635,411 | A | * | 1/1987 | Kurzen | 52/71 |
| 4,689,924 | A | * | 9/1987 | Jurgensen | 52/67 |
| 4,696,132 | A | | 9/1987 | LeBlanc | 52/69 |
| 4,818,637 | A | | 4/1989 | Molter et al. | 429/15 |
| 4,854,094 | A | | 8/1989 | Clark | 52/79.1 |
| 4,878,637 | A | | 11/1989 | Mullen | 244/159 |
| 4,891,919 | A | | 1/1990 | Palibroda | 52/79.5 |
| 4,958,874 | A | * | 9/1990 | Hegedus | 296/26.02 |
| 5,060,426 | A | * | 10/1991 | Jantzen | 52/86 |
| 5,084,164 | A | | 1/1992 | Del Rosario | 210/94 |
| 5,086,999 | A | | 2/1992 | Mullen | 244/159 |
| 5,152,109 | A | * | 10/1992 | Boers | 52/143 |
| 5,167,575 | A | * | 12/1992 | MacDonald | 454/187 |
| 5,345,730 | A | * | 9/1994 | Jurgensen | 52/64 |
| 5,369,920 | A | * | 12/1994 | Taylor | 52/79.1 |
| 5,381,633 | A | * | 1/1995 | Hendrich | 52/71 |
| 5,444,944 | A | * | 8/1995 | Roelofsz | 52/64 |
| 5,447,000 | A | | 9/1995 | Larsen | 52/79.1 |
| 5,463,833 | A | * | 11/1995 | Banez | 52/71 |
| 5,493,817 | A | * | 2/1996 | Speer | 52/69 |
| 5,493,818 | A | | 2/1996 | Wilson | 52/71 |
| 5,706,614 | A | | 1/1998 | Wiley, Jr. et al. | 52/79.1 |
| 5,706,615 | A | | 1/1998 | Bridges et al. | 52/105 |
| 5,709,615 | A | | 1/1998 | Liang | 473/324 |
| 5,761,854 | A | | 6/1998 | Johnson et al. | 52/69 |
| 5,765,316 | A | | 6/1998 | Kavarsky | 52/67 |
| 5,890,341 | A | | 4/1999 | Bridges et al. | 52/745.2 |
| 5,950,373 | A | | 9/1999 | von Hoff et al. | 52/79.5 |
| 5,966,956 | A | * | 10/1999 | Morris et al. | 62/259.1 |
| 6,070,372 | A | * | 6/2000 | Norman et al. | 52/71 |

* cited by examiner

*Primary Examiner*—Jeanette Chapman
(74) *Attorney, Agent, or Firm*—Gifford, Krass, Groh, Sprinkle, Anderson & Citkowski, P.C.

(57) ABSTRACT

An engineered purpose-built portable habitable structure formed of a transformable rectangular enclosure that includes a base shell having hingedly attached exterior and interior walls that fold out to form a habitable structure. The walls of the structure are pre-wired and pre-plumbed and are adapted to connect to appropriate supply sources exterior to the structure.

10 Claims, 6 Drawing Sheets

CONTAINERIZED HABITABLE STRUCTURES

RELATED APPLICATIONS

This application is a continuation of U.S. patent application Ser. No. 09/965,741 filed Sept. 28, 2001, now abandoned, which claims priority of U.S. Provisional Patent Application Ser. No. 60/236,188 filed Sep. 29, 2000.

FIELD OF THE INVENTION

This invention relates to a portable containerized habitable structure. More particularly, the present invention relates to a structure that can be completely stored in an engineered, purpose-built, portable ISO shipping container that is constructed to be hingedly transformed into a habitable unit.

BACKGROUND OF THE INVENTION

In the modular building industry a variety of relocatable structures are provided for commercial and industrial uses.

In some instances steel shipping containers that have been taken out of service are converted into habitable structures. Generally, the structures are prefabricated and then transported to a use site. These structures are satisfactory for their intended purpose, but the usable habitable space is limited to the interior volume of the shipping container. Once converted they usually void their ISO Rating, as the unit is only engineered to be a shipping container and not a purpose built habitable structure with the ability to pass ISO certification requirements.

To overcome the disadvantages experienced with the heretofore employed buildings having steel shipping container cores, the present invention has been devised.

SUMMARY OF THE INVENTION

The habitable structure of the present invention is formed of an engineered, purpose-built transformable rectangular enclosure comprising a top wall portion and a transformable rectangular container portion integral with the top wall portion. Preferably, the rectangular is dimensioned to at least one of the ISO sizes of containers conventionally used for sending freight by ship or plane to accommodate efficient and convenient transportability.

The transformable rectangular container comprises first and second container walls hingedly attached to opposing elongated edges of the base at one of each of their elongated edges. The attachment is made such that the container walls can be pivotally placed in a perpendicular or horizontal position relative to the base as desired. When the container walls are placed in a horizontal position relative to the base, they form an extended area of the floor of the habitable structure along with the base.

First and second roof expander portions are hingedly attached to the opposing elongated edges of a top wall portion of the transformable container. Each roof expander is attached to the container top wall portion along a first elongated edge. The roof expander portions are dimensioned proportionately in size and shape to the container walls and are selectively positionable in a perpendicular or horizontal position relative to the container top wall portion. When the roof expanders are horizontal to the top wall portion, they function as part of the roof of the habitable structure.

First and second end portions are fixedly and perpendicularly attached at opposite ends of the base and the top wall to form the frame or body of the rectangular container that may be used to store additional components of the habitable structure which will be described hereinafter.

First and second exterior walls are attached to the second elongated edges of the roof expander portions that are attached to the top wall portions along their first elongated edge. At a first elongated edge, the exterior walls are attached to the roof expanders such that when the roof expanders are placed in a horizontal position relative to the top wall portion, the exterior walls can be placed either in a perpendicular or horizontal position.

When the exterior walls are placed in the perpendicular position, they serve as a substantial portion of the exterior of the habitable structure. Preferably, each of these exterior walls includes at least one door and at least one window. The exterior walls are adapted to be fastened to the second elongated edges of the container walls such that they stand fixedly perpendicular between the base and the top wall portion. The walls are fastened through the use of a conventional fastening means suited for such purpose.

Once the container walls (base expanders), the roof expanders, and the exterior walls have been folded out as steps in forming the habitable structure, a plurality of exterior sidewalls that are hingedly attached to the frame and/or end portions of the transformable container are folded out to complete the construction of the exterior wall surface.

In an alternative embodiment, a plurality of separate exterior sidewalls may be included and used to complete the exterior wall surface of the habitable structure to finish the overall exterior assembly. The exterior sidewall panels are adapted for slip fit engagement into the gaps within the exterior walls and are secured in placed through the use of a conventional fastening means suited for such purpose.

Alternatively, the exterior sidewalls may be hingedly attached to the end portions of the core unit along the elongated side edges. At a first elongated edge of an end portion, the exterior sidewalls are attached such that when shipped they are placed in a perpendicular position relative to the end portion and parallel position relative to the container walls, the exterior sidewalls can be placed only be in a perpendicular or parallel position relative to the end portions.

When the exterior sidewalls are placed in the parallel position relative to the end portion, they serve as a substantial portion of the exterior of the habitable structure. The exterior sidewalls are to be fastened to the structure such that they stand fixedly perpendicular between the expanded floor and the expanded roof. The exterior sidewalls are fastened through the use of a conventional fastening means suited for such purpose.

In an alternative embodiment, both the exterior sidewall and roof panels may be stored within the body of the rectangular container when the containerized structure is in its portable configuration.

Finally, the interior of the habitable structure is compartmentalized by selectively positioning a plurality of interior walls that are hingedly attached to the frame elements of the containerized structure. These interior walls preferably include at least one door such that a practical and comfortable living environment is attained.

BRIEF DESCRIPTION OF THE DRAWINGS

To further describe the nature and objects of the present invention, reference should be had to the following detailed description taken in conjunction with the accompanying drawings in which like parts are given like reference numerals and wherein:

FIG. 1G is a perspective view of an alternative embodiment that uses separate roof panels and exterior sidewalls that are manually positioned and fastened in place;

DETAILED DESCRIPTION OF THE INVENTION

Figure 1A:
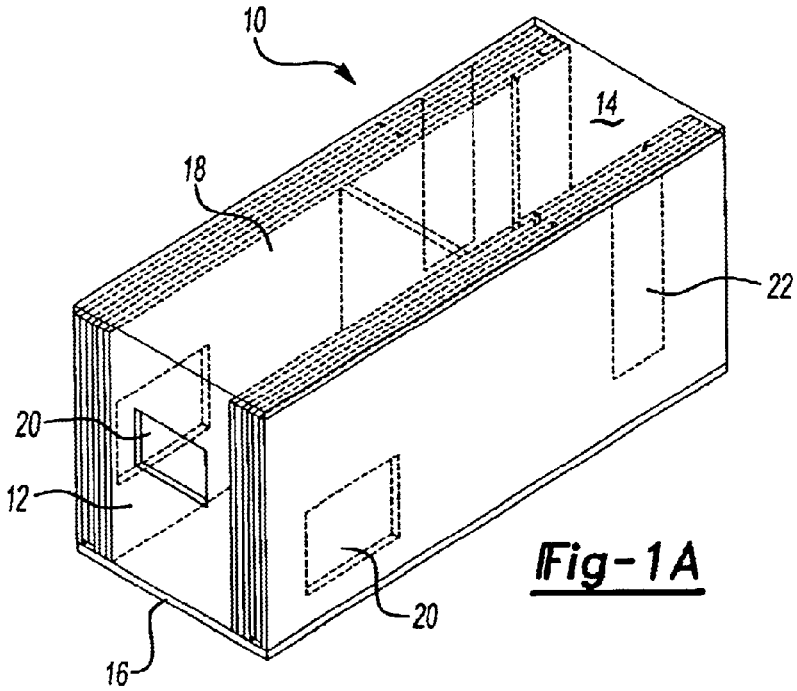
FIGS. 1A–1I are perspective view illustrations of a rectangular enclosure being transformed into a habitable structure as according to the invention.

Referencing FIG. 1A, an engineered, purpose-built, portable transformable rectangular enclosure 10 includes a transformable rectangular container integral to a top wall portion. Preferably, the rectangular enclosure is dimensioned to at least one of the ISO sizes of containers conventionally used for sending freight by ship or plane to accommodate transportability. Most preferably, the container is dimensioned to be between 20–53 feet in length, 8–10 feet in width, and 8.5–9.5 feet in height. The transformable rectangular container has first 12 and second 14 end portions that are perpendicularly fixed between the container base 16 and a top wall 18.

Figure 1B:
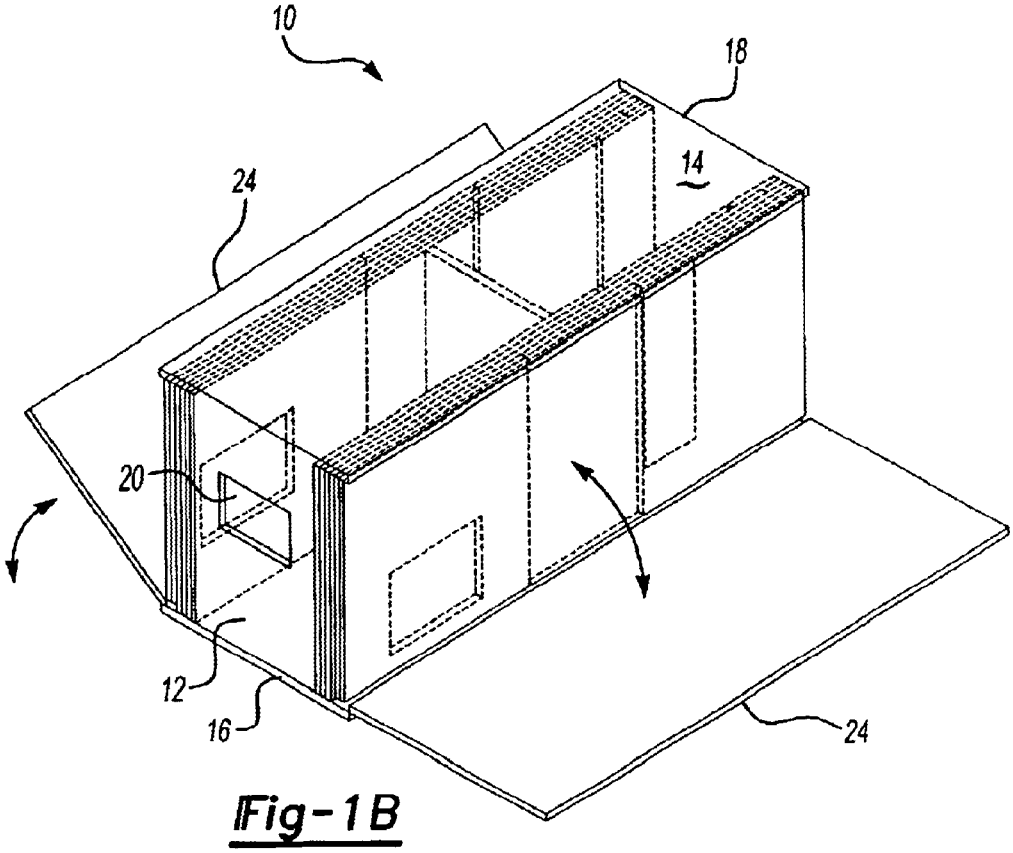
Figure 1C:
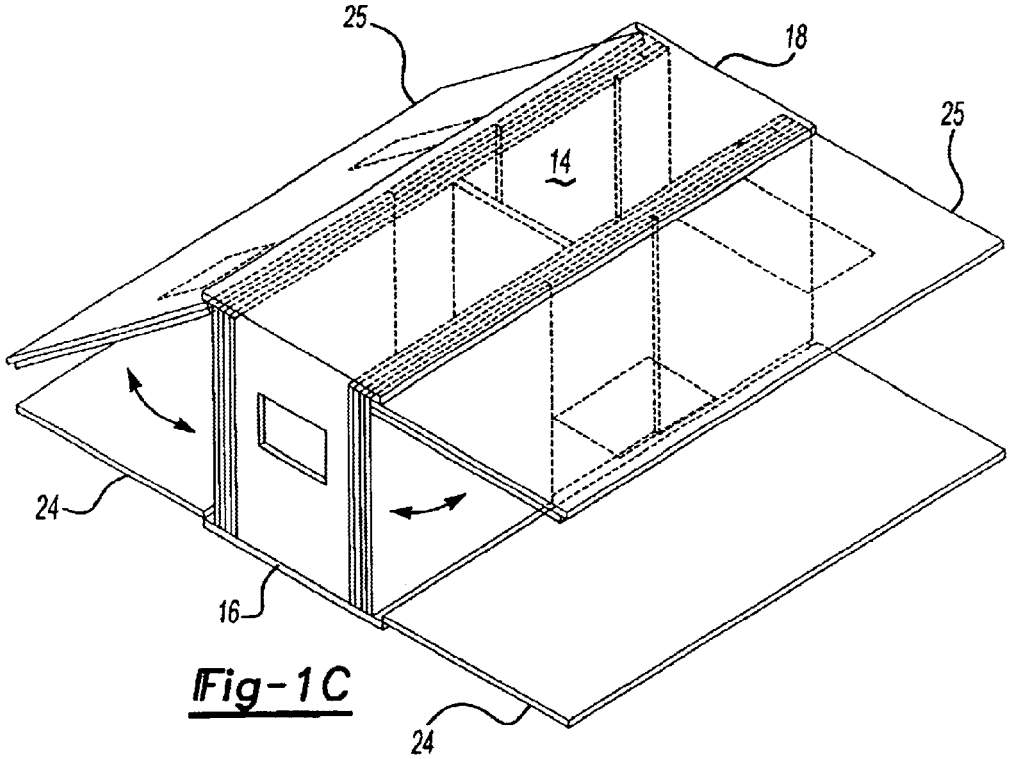

In a preferred embodiment, the end portions include at least one window 20 and/or a door 22 opening. Preferably, the lengths or sides 24 of the container are single doors that hingedly pivot horizontally along the elongated edge of the base 16 versus pivoting vertically as do most doors. (See FIG. 1B). These lengths will be referred to as base expanders 24 hereinafter. Similarly, the roof expanders 25 shown in FIG. 1C, are substantially proportional in size and shape to the base expanders 24, and are hingedly attached along an elongated edge of the container top wall 18.

Figure 1D:
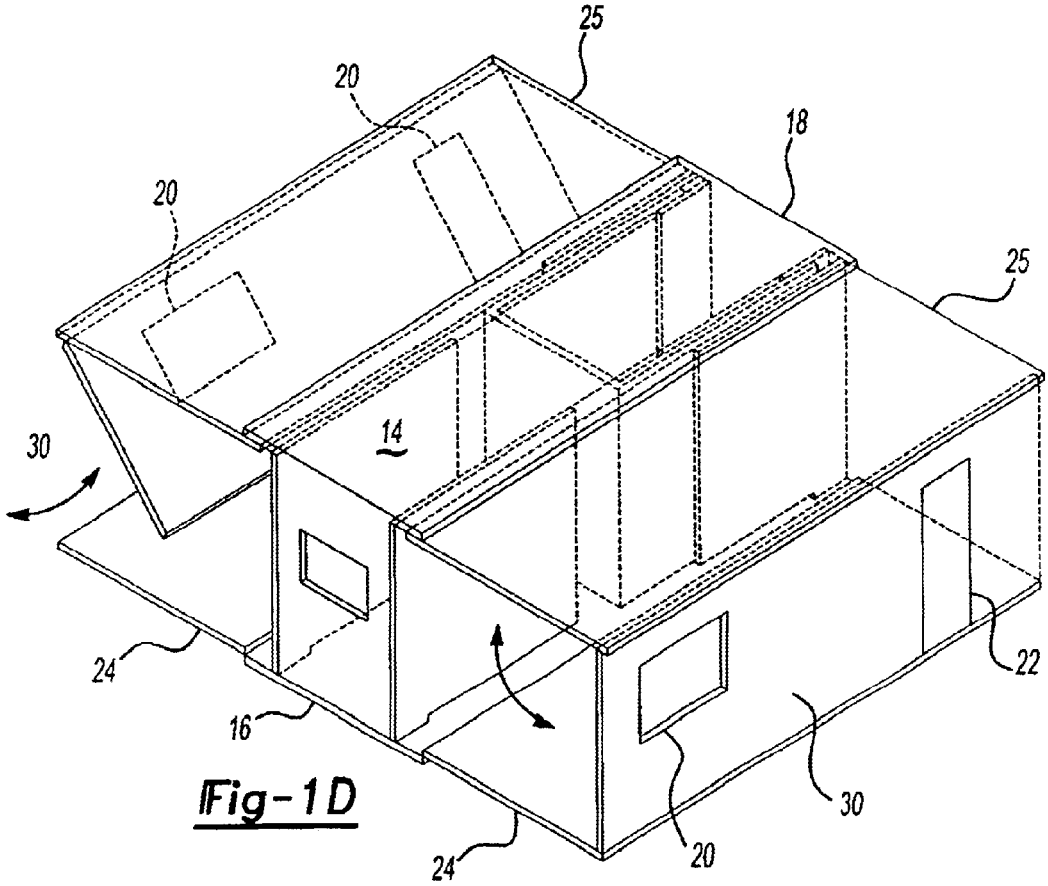
Figure 1E:
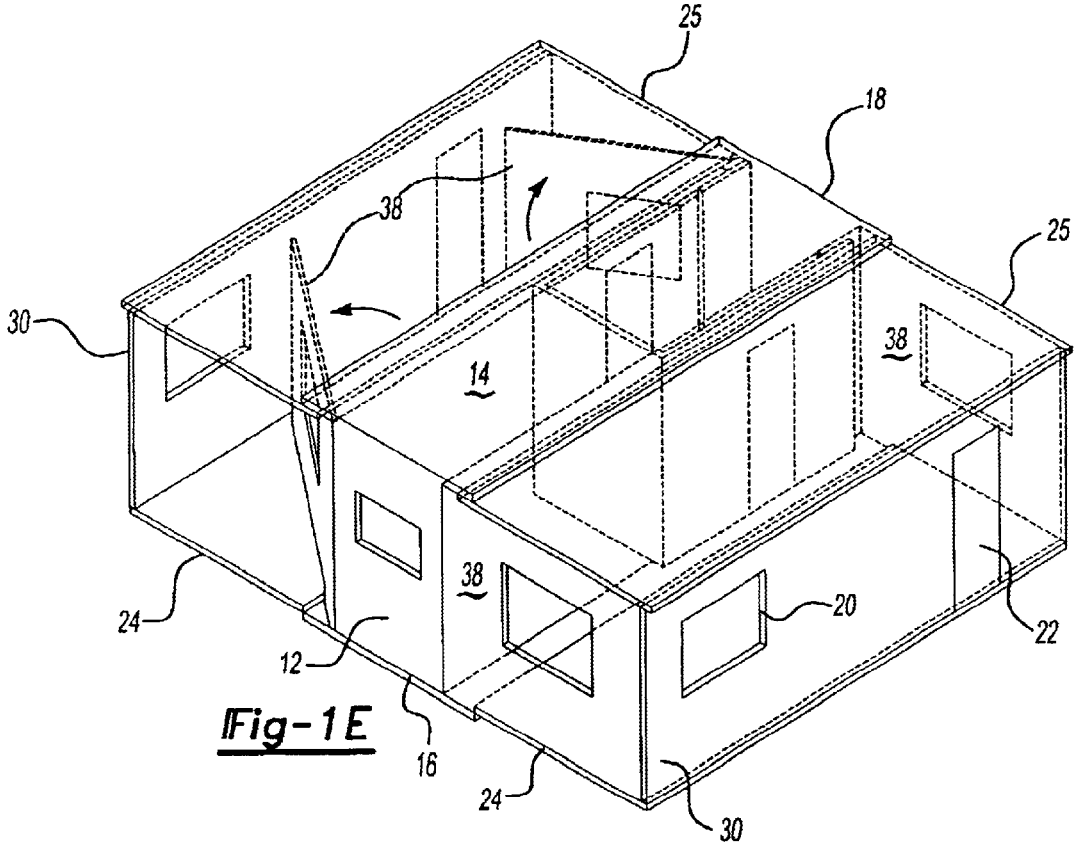

The roof expanders 25 are hingedly attached to the top wall 18 of the container such that the walls can be selectively lifted up to a horizontal position where they function together with top wall to form the roof of the habitable structure, see FIG. 1D. Still referring to FIG. 1D, the transformable container includes finished or unfinished exterior walls 30 that preferably include windows and doors and are hinged to an elongated edge of the roof expanders 25 such that the exterior walls 30 can be pivoted out from a horizontal to a vertical position. The exterior walls are then fastened to the free edges of the base expanders 24 such that they stand perpendicular between the base expanders 24 and the roof expanders 25. (See FIG. 1E).

Alternatively, the exterior walls 30 may be manually placed into position and fastened with a conventional fastening means suited for such purpose.

Figure 1F:
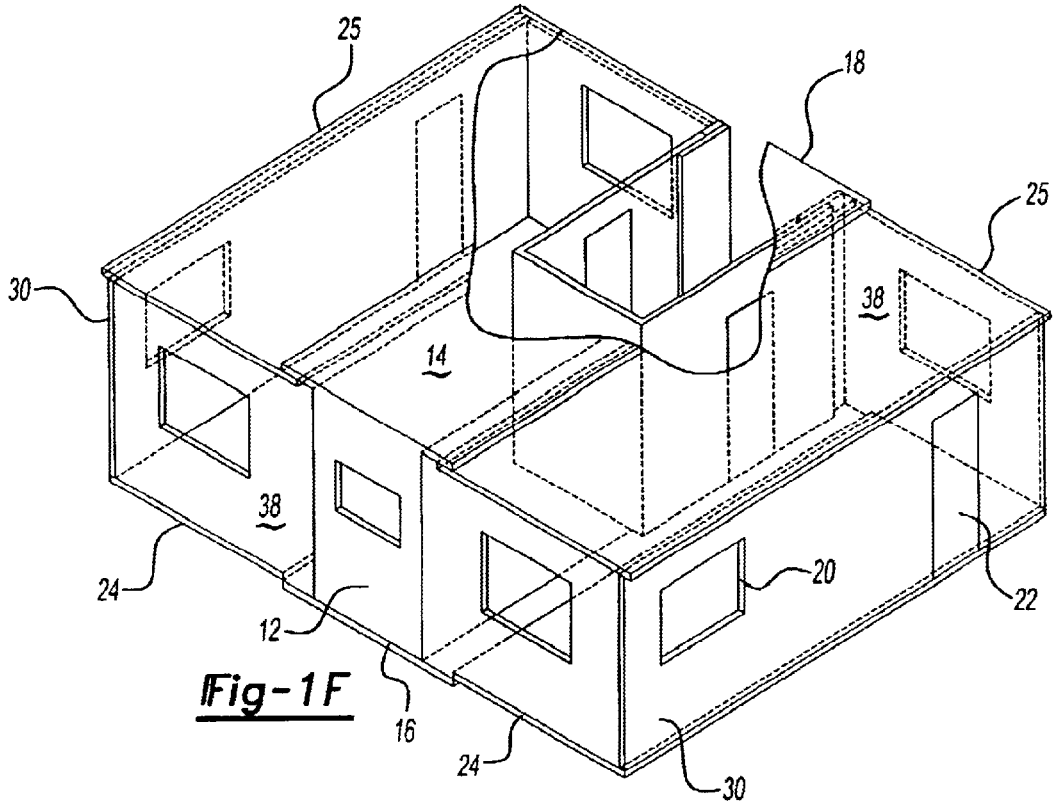

A structure contains a plurality of exterior sidewalls 38 which may be finished or unfinished and preferably have doors 22 and/or windows 20 therein. (See FIGS. 1E and 1F). Preferably, these exterior sidewalls 38 are hingedly and pivotally attached to either the exterior walls 30 and/or the end portions 12 or 14 and/or the frame of the containerized enclosure 10 and are folded into place as part of the exterior wall surface.

In an alternative embodiment, the exterior sidewalls or panels **38*a* may be separate and are manually placed into position and fastened by a conventional fastening means for such purpose. (See FIG. 1G). Additionally, the structure may include separate panels 40** that are used to form portions of the roof of the habitable structure. These panels are also manually positioned and fastened in place with a conventional fastening means suited for such purpose.

In the preferred embodiment, the structure includes interior walls 32 which can be finished or unfinished and are hingedly attached to the first and/or second end portions and/or frame 33 and/or other interior walls 31 of the containerized enclosure 10 and can be selectively positioned to compartmentalize the interior of the habitable structure. (See FIG. 1H). Preferably, the interior walls 32 include at least one door to provide a practical and comfortable living environment where individuals can look into or move between various rooms inside the structure. (See FIG. 1I).

Figure 1G:
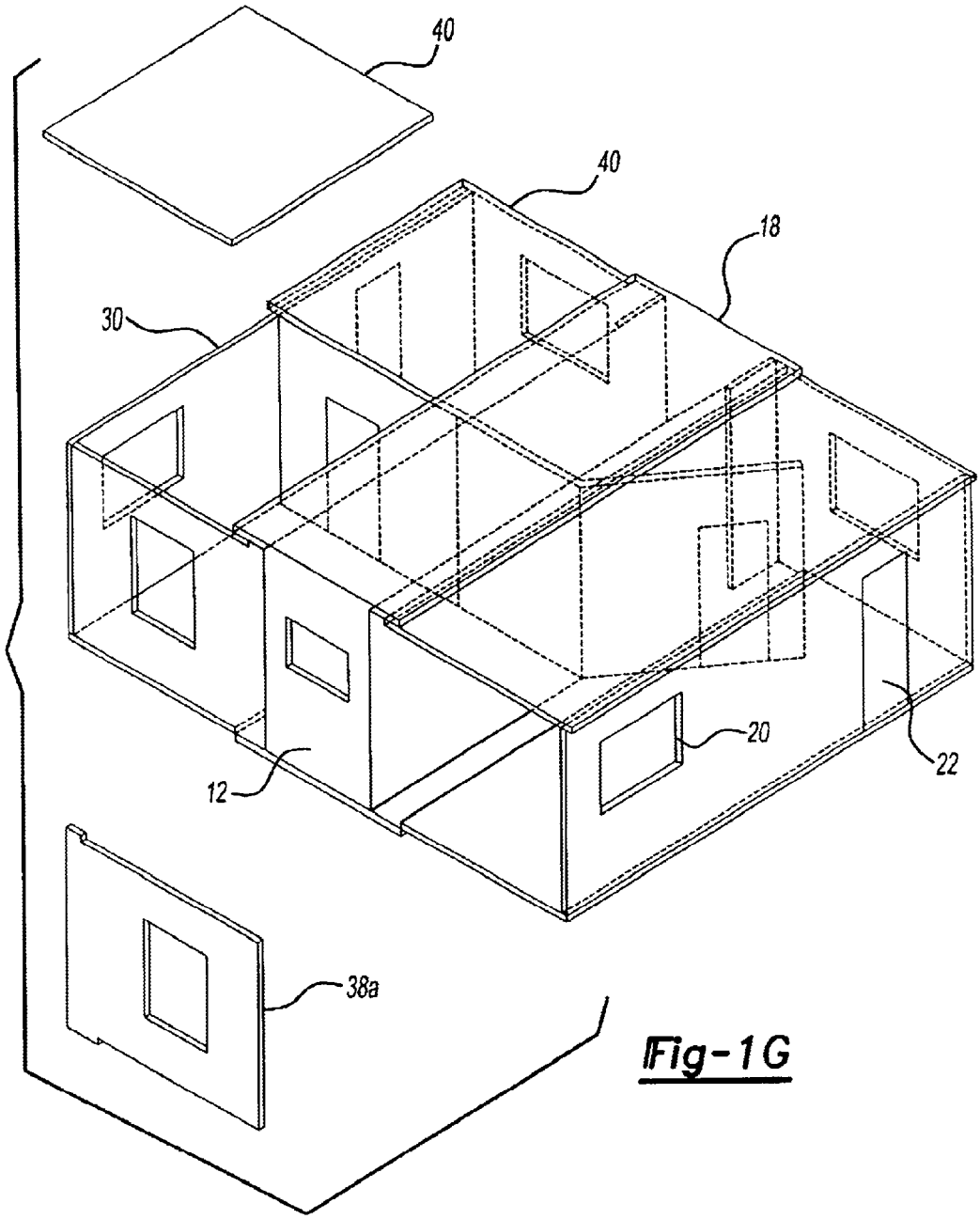
Figure 2:
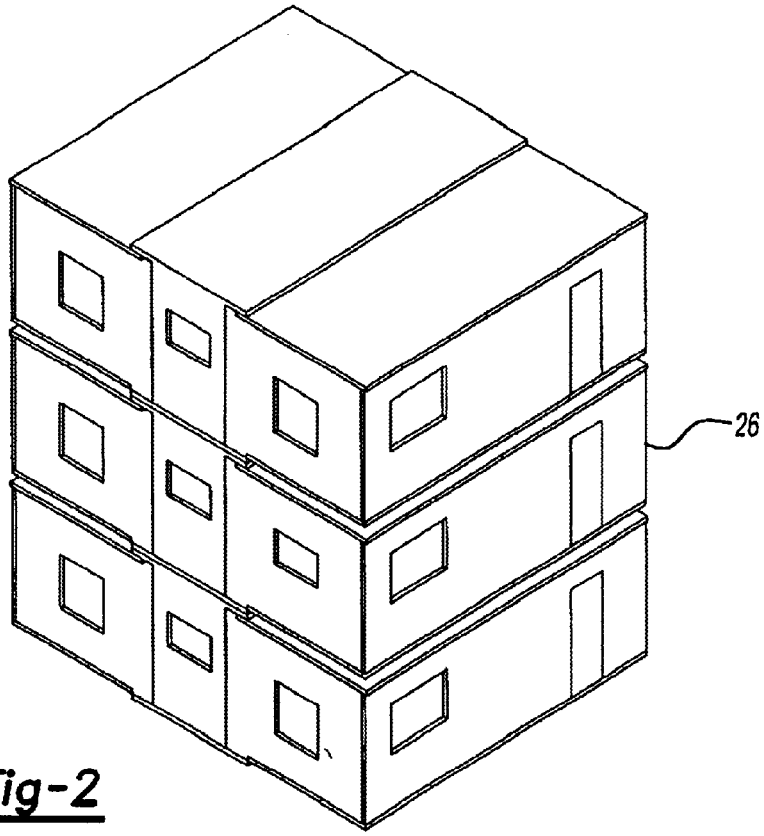
FIG. 2 is a perspective view illustrations of multi-level habitable structures as according to the invention.

With reference to FIG. 2, a multi-level structure 26 is shown that is constructed by combining two or more of the transformable rectangular enclosures in a stacked configuration after they have been converted into the habitable structure. In this configuration, only the extreme top-level structure requires roofing panels 40 to be put in place, as according to the alternative embodiment of FIG. 1G. As best illustrated in FIG. 2, each sublevel of the multi-level structure may use the base and base expanders of the next level as its ceiling while the superior level uses additional panels to form the roof but preferably the roof is formed of the hingedly attached roof expanders as shown in FIG. 1C.

Figure 3:
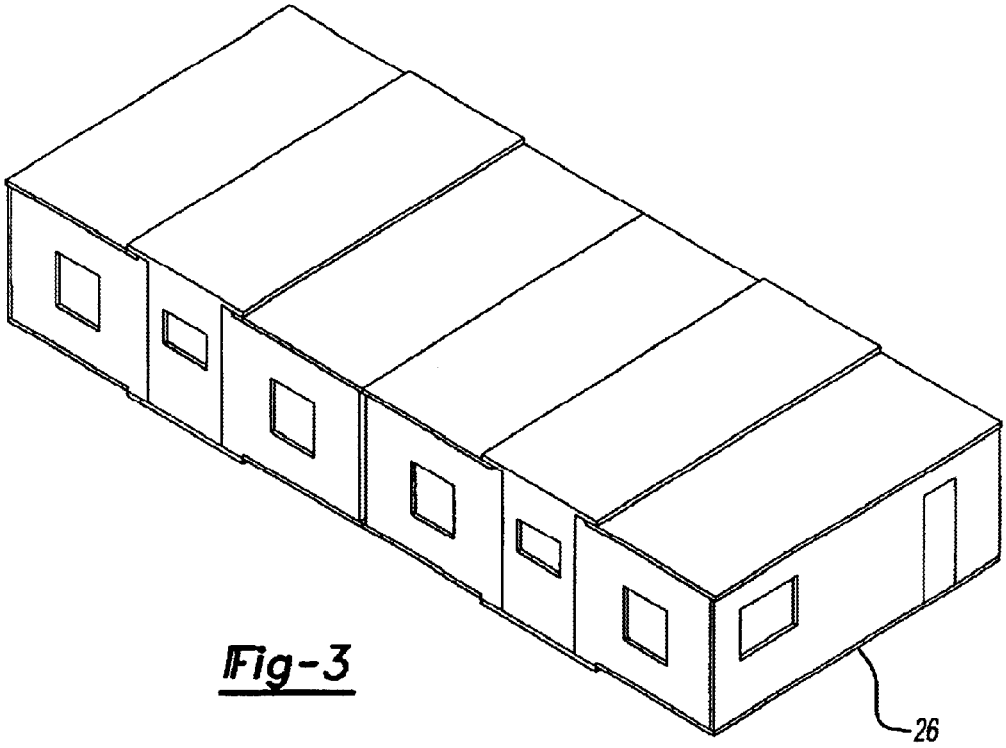
FIG. 3 is a perspective view of multiple containerized structures combined to form an expanded single level habitable structure.

Alternatively, the transformable containers can be constructed adjacent to one another to form an expanded single level habitable structure as best shown in FIG. 3.

Figure 1H:
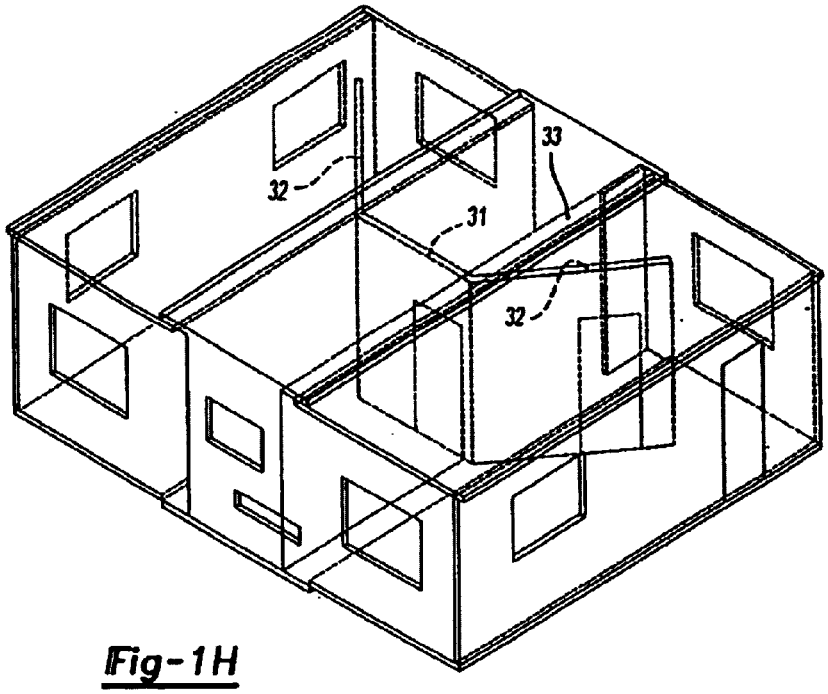
Figure 1I:
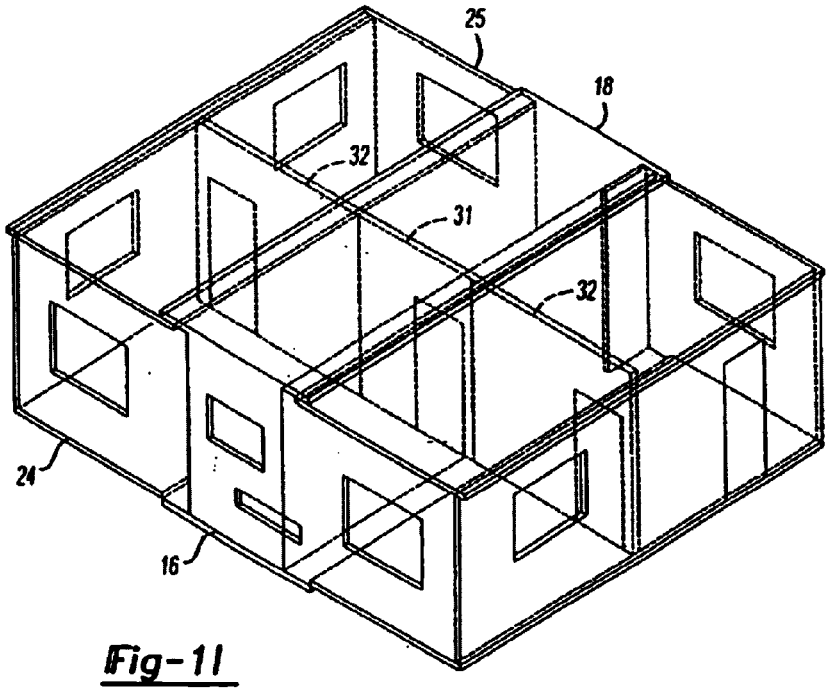

In the alternative embodiment as shown in FIG. 1G, the exterior sidewalls **38*a*, and/or roof panels 40 that are not hingedly attached to the rectangular frame 33** structure are capable of being stored inside the container during transport. Additionally, the interior of the habitable structure is compartmentalized into areas that include a kitchen and a bathroom. Preferably, the kitchen includes cabinets, a refrigerator, a stove and sink; and the bathroom includes a toilet, a shower, cabinets with a sink and additional room for a washer and dryer and other amenities.

In the preferred embodiment, the walls of the transformable rectangular container are pre-wired and pre-plumbed and have a conventional means to connect with an appropriate central supply source for electricity and water. The walls are fabricated having dual channel recessed grooves to accommodate high and low voltage lines for electrical power and additional grooves to accommodate the piping necessary to provide water to desired locations throughout the structure.

Prior to use, the transformable enclosure is transformed into a habitable structure by first folding out the container walls of the enclosure, which are fastened at a horizontal position with the base to form the floor of the structure. Alternatively, the container walls are hingedly attached to the container top wall and are folded up to form the roof.

Next, the roof panels are folded out from within the enclosure and are fastened at a horizontal position with the top wall portion of the container, to form the expanded-roof of the structure.

Then, the exterior walls, which are hingedly attached to the roof, are folded out and down to form a substantial portion of the exterior walls.

Finally, the hingedly attached exterior sidewalls and interior walls, if any, are folded out to complete the process. All the walls are adapted to be secured in place after being folded out by a conventional fastening means suitable for such purpose.

All the structures have a base shell and exterior and interior openings. The floor plans, bathrooms, kitchens, electrical, plumbing and finishes are assembled or manufactured into the shell as ordered. During the folding out process the hinged walls compress gaskets to substantially seal the unit. In the preferred embodiment, all panels are set and hinged in place during the manufacturing process such that the structure is shipped having hingedly attached panels that are pivotally positioned into place during deployment. If desired, the structures can be made entirely without wood.

The foregoing figures and descriptions thereof are provided as illustrative of some of the preferred embodiments of the concepts of this invention and is not intended all-inclusive. For example, the present invention may be used as a non-habitable structure such as a portable storage facility. It is to be understood that various changes in the shape, size and arrangement of the components of the structure may be resorted to without departing from the spirit of the invention or scope of the claims as presented.

We claim:

1. A portable habitable structure formed of a engineered, purpose-built transformable rectangular enclosure, said enclosure being dimensioned a standard size of containers used for sending freight by plane or ship, said enclosures comprising:

a base; and a transformable rectangular container portion integral with said base, said transformable rectangular container portion comprising:

a first container wall, a second container wall, and a top wall portion, said container walls being hingedly attached to opposing elongated edges of said base such that the container walls are movable between a perpendicular or horizontal position relative to the base;

a first and a second end portions, said end portions being fixedly and perpendicularly attached to opposite ends of the top wall portion and the base;

a first roof expander and a second roof expander, both being hingedly attached to said top wall portion along its opposing elongated edges such that said roof expanders are movable to a perpendicular or horizontal position relative to the top wall portion;

a first exterior wall and a second exterior wall, at least one of said exterior walls having at least one window and at least one door, said first exterior wall being hingedly attached to said first roof expander such that the first exterior wall can be placed in a perpendicular or horizontal position relative to the top wall portion when the first roof expander portion is horizontal to the top wall portion, said second exterior wall being hingedly attached to said second roof expander such that the second exterior wall can be placed in a perpendicular or horizontal position relative to the top wall portion when the second roof expander portion is horizontal to the top wall portion, said first and second exterior walls being adapted to detachedly fasten to a position perpendicular to the first and second roof expanders respectively;

a plurality of exterior sidewalls hingedly attached to said first and second end portions such that said exterior sidewalls are pivotable to fill gaps between the first and second exterior walls and the first and second end portions; and a plurality of interior walls hingedly attached to a frame of the containerized enclosure such that said interior walls can be positioned as desired to compartmentalize the interior of the habitable structure whereby at least one interior wall having at least one door.

2. The habitable structure of claim 1 wherein the first and second container walls are multi-piece container walls.

3. The habitable structure of claim 1 wherein the base and the container walls function as a floor for the containerized structure.

4. The habitable structure of claim 1 wherein the top wall portion and the roof expanders function as a roof for the containerized structure.

5. The habitable structure of claim 1 wherein the exterior walls are detachedly fastened perpendicularly to the roof expanders.

6. The habitable structure of claim 1 wherein the exterior walls are hingedly attached and fastened in place.

7. The habitable structure of claim 1 wherein the roof expanders are hingedly attached and fastened in place.

8. The habitable structure of claim 1 wherein the interior walls are hingedly attached and fastened in place.

9. The habitable structure of claim 1 wherein the walls are pre-wired and pre-plumbed.

10. A portable multi-level habitable structured formed of a plurality of engineered purpose-built transformable rectangular containerized enclosures, said enclosures being dimensioned a standard size of containers used for sending freight by plane or ship, said enclosures comprising:

at least two containerized enclosures selectively transformed into a habitable structure and arranged in a stacked configuration, each containerized enclosure comprising:

a top wall portion; and a transformable rectangular container portion integral with said top wall portion, said transformable rectangular container portion comprising: a first container wall, a second container wall, and a base, said container walls being hingedly attached to opposing elongated edges of said top wall portion such that the container walls are movable to a perpendicular or horizontal position relative to the top wall portion; a first and a second end portions, said first and second end portions being fixedly and perpendicularly attached to opposite ends of the top wall portion and said base; a first and a second base expander portions, said first and second base expander portions being hingedly attached to opposing elongated edges of the base such that the base expander portions are movable between a horizontal or a perpendicular position relative to said base;

a first exterior wall and a second exterior wall wherein at least one of said exterior walls has at least one window and at least one door, said first exterior wall being hingedly attached to said the first base expander portion such that the first exterior wall can be placed in a perpendicular or horizontal position relative to the base when the first base expander portion is horizontal to the base, said second exterior wall being hingedly attached to said second base expander portion such that the second exterior wall can be placed in a perpendicular or horizontal position relative to the base when the second base expander portion is horizontal to the base, said first and second exterior walls being adapted to detachedly fasten perpendicularly to the first and second base expanders; respectively;

a plurality of exterior sidewalls hingedly attached to said first and second end portions such that said exterior sidewalls are pivotable to fill gaps between the first and second exterior walls and the first and second end portions; and a plurality of interior walls hingedly attached to a frame of the containerized enclosure such that said interior walls can be positioned as desired to compartmentalize the interior of the habitable structure wherein at least one interior wall has at least one door.

* * * * *